US011642672B2

(12) United States Patent
Dupouy et al.

(10) Patent No.: US 11,642,672 B2
(45) Date of Patent: May 9, 2023

(54) MICROFLUIDIC NETWORK DEVICE

(71) Applicant: ECOLE POLYTECHNIQUE FEDERALE DE LAUSANNE (EPFL), Lausanne (CH)

(72) Inventors: Diego Gabriel Dupouy, Préverenges (CH); Ata Tuna Ciftlik, Morges (CH); Martin Gijs, Ecublens (CH); Pierre Joris, Le Levron (CH)

(73) Assignee: ECOLE POLYTECHNIQUE FEDERALE DE LAUSANNE (EPFL), Lausanne (CH)

( * ) Notice: Subject to any disclaimer, the term of this patent is extended or adjusted under 35 U.S.C. 154(b) by 567 days.

(21) Appl. No.: 16/086,330

(22) PCT Filed: Mar. 21, 2017

(86) PCT No.: PCT/EP2017/056609
§ 371 (c)(1),
(2) Date: Sep. 19, 2018

(87) PCT Pub. No.: WO2017/162617
PCT Pub. Date: Sep. 28, 2017

(65) Prior Publication Data

US 2019/0099754 A1 Apr. 4, 2019

(30) Foreign Application Priority Data

Mar. 23, 2016 (EP) ..... 16162091

(51) Int. Cl.
*B01L 3/00* (2006.01)

(52) U.S. Cl.
CPC . *B01L 3/502738* (2013.01); *B01L 2300/0816* (2013.01); *B01L 2300/0867* (2013.01); *B01L 2300/0883* (2013.01); *B01L 2300/123* (2013.01); *B01L 2400/0487* (2013.01);
(Continued)

(58) Field of Classification Search
None
See application file for complete search history.

(56) References Cited

U.S. PATENT DOCUMENTS 8,075,852 B2 * 12/2011 Gao ..... G01N 33/54366 422/503
2006/0076068 A1 4/2006 Young et al.
2007/0166199 A1 7/2007 Zhou et al.
(Continued)

FOREIGN PATENT DOCUMENTS

JP 2005-195561 A 7/2005
JP 2008-545102 A 12/2008
(Continued)

OTHER PUBLICATIONS

International Search Report and Written Opinion of the ISA for PCT/EP2017/056609 dated Jun. 23, 2017, 15 pages.

*Primary Examiner* — Lore R Jarrett
(74) *Attorney, Agent, or Firm* — Nixon & Vanderhye P.C.

(57) ABSTRACT

Microfluidic network device (2) configured to supply reagents to a biological tissue sampling device (1), comprising a plurality of microfluidic inlet channels (12) connected to respective sources of said reagents, at least one common outlet channel (22), and a plurality of valves (36) interconnecting an outlet end (14) of each of said plurality of inlet channels to said at least one common outlet channel.

13 Claims, 8 Drawing Sheets

Figure 1:
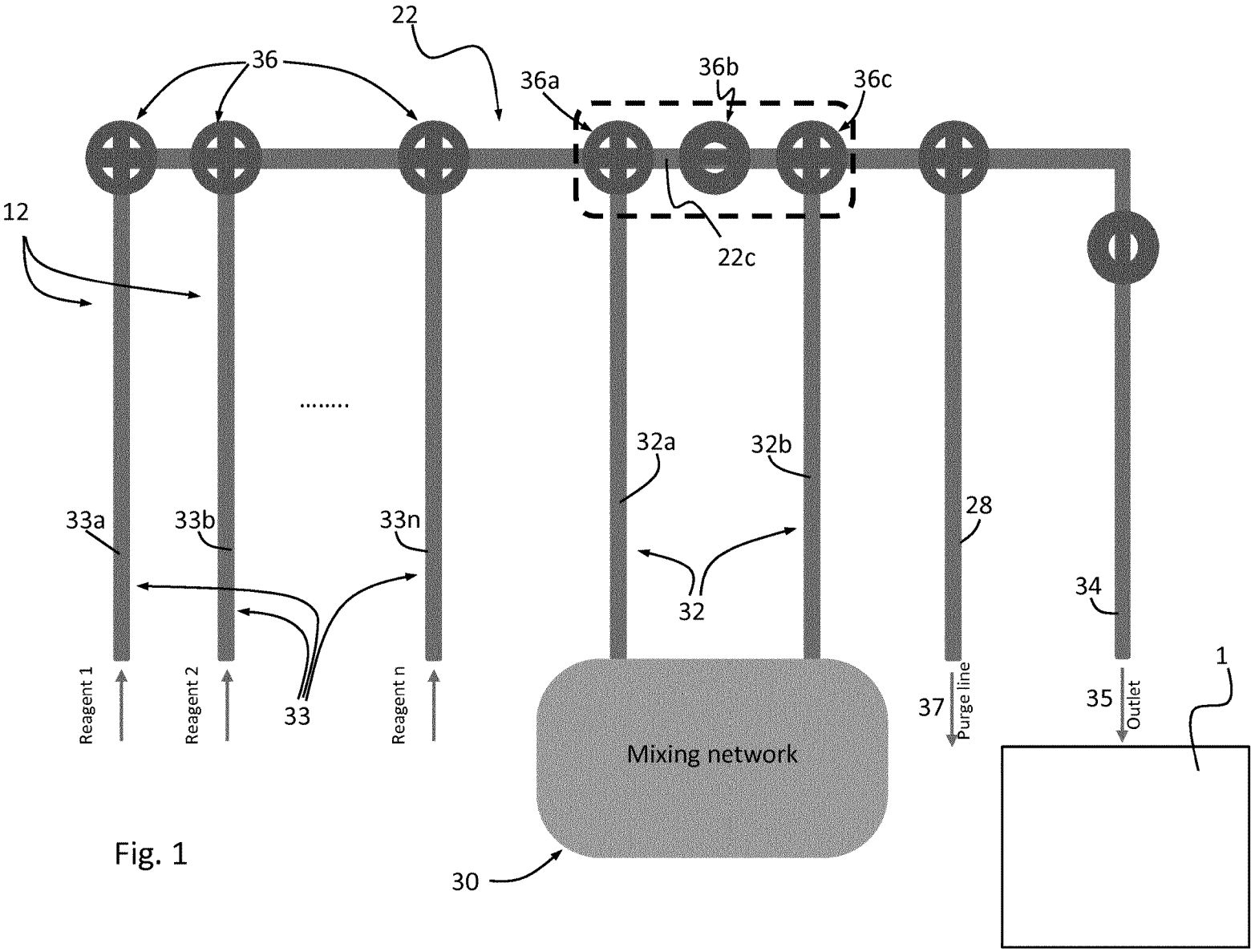

(52) U.S. Cl.
CPC ..... *B01L 2400/0638* (2013.01); *B01L 2400/0655* (2013.01)

(56) References Cited

U.S. PATENT DOCUMENTS

| | | | | |
|---|---|---|---|---|
| 2007/0267335 | A1* | 11/2007 | Gao | G01N 33/54366 210/120 |
| 2011/0233446 | A1* | 9/2011 | Chuang | B01F 33/30 251/359 |
| 2012/0039770 | A1* | 2/2012 | Namkoong | F16K 99/0015 422/504 |
| 2012/0136492 | A1* | 5/2012 | Amin | B01L 3/502723 700/285 |
| 2012/0201725 | A1 | 8/2012 | Imran | |
| 2013/0096031 | A1 | 4/2013 | Wan | |
| 2014/0352819 | A1 | 12/2014 | Pugliese et al. | |
| 2015/0021501 | A1 | 1/2015 | Ono et al. | |

FOREIGN PATENT DOCUMENTS

| | | | |
|---|---|---|---|
| JP | 2011-004608 | A | 1/2011 |
| JP | 2011-041925 | A | 3/2011 |
| WO | 2015/183871 | | 12/2015 |

* cited by examiner

MICROFLUIDIC NETWORK DEVICE

This application is the U.S. national phase of International Application No. PCT/EP2017/056609 filed Mar. 21, 2017 which designated the U.S. and claims priority to EP Patent Application No. 16162091.9 filed Mar. 23, 2016, the entire contents of each of which are hereby incorporated by reference.

The present invention relates to a microfluidic network device with valves to control flow of fluids in channels of the microfluidic network. The microfluidic network device may be used to deliver reagents and sample liquids to a sampling device, or for mixing of different liquids.

The present invention is particularly useful for use in the field of reagent delivery in microfluidics, for instance for sequential delivery of reagents from on-chip reservoirs or external containers to microfluidic devices, chambers or networks.

Cartridge-based reagent delivery systems and methods with different actuation schemes and configurations are known, however many are suitable only for very specific applications and are not versatile or do not resolve problems of possible cross-contamination or low dead volume.

In US2011/0243815, the pressure inside a liquid chamber can be adjusted to transfer the reagents by using valves employing a membrane which is impermeable to liquids but allows gases to pass as an element of a check-valve. The described system delivers pre-determined volumes of reagents but is not suitable for delivery of multiple reagents and a portion of the reservoir volume is used by the pressurized gas, hence decreasing the maximum amount of reagents which can be delivered.

Another approach is the use of an impermeable and stretchable membrane as the actuation element for valving or pumping of reagents, as disclosed in U.S. Pat. No. 4,119,120. In U.S. Pat. No. 6,948,918, a micropump utilizing a stretchable membrane as the actuation element is disclosed where the membrane is deflected onto grooves on a substrate with fixed volumes to transfer the liquid. An important drawback is that since it is designed for the delivery of pre-determined volume amounts and has a single reservoir, it lacks versatility and is suitable only for specific applications.

An actuated membrane approach is implemented with different elastic materials as disclosed in U.S. Pat. No. 7,832,429 and US20140093431. Pneumatically actuated networks of valves and pumps are provided for routing and transport of liquids, however the reservoirs have to be provided externally.

Another cartridge-based pneumatic delivery system is disclosed in US20140322100. The cartridge is divided into the pneumatic and fluidic sections divided by an elastic membrane.

Leak-free operation is presented as an advantage with the help of laser welding more than one membrane layer in the actuation areas. The device however is not versatile and does not allow low dead volume operation.

A diaphragm microvalve fabricated as a single piece is disclosed in US20110240127. The device has a normally closed structure with a pneumatic actuation scheme and systems including a valving device for the purpose of performing various assays on chip are also disclosed in the invention. An important drawback of this valve structure is the possibility of back flow and cross contamination between reagents. Dead volume swept through the microchannels after the valves is also a disadvantage. A similar structure with the same drawbacks is disclosed in US20150021502 where the device is composed of several pieces and the actuation membrane is mechanically sealed using a sealing ring.

Another membrane valve based approach is disclosed in US20150021501. The device seeks to remove the need to continuously keep the membrane driven to keep the valve closed. For this purpose, an additional layer is bonded on the valve membrane to act as the pneumatic actuation seat. The remaining aspects of the invention are similar to other in-line normally closed valve structures and shares at least some of the drawbacks discussed above.

A fluid manipulation device featuring a detachable version of the membrane valve approach is disclosed in US20110315227. The valve seat, actuation and fluid layers are provided as different pieces. The combined structure shares the aforementioned drawbacks of other membrane based systems.

A nucleic acid preparation device disclosed in U.S. Pat. No. 5,863,801 includes plunger type valving mechanisms. A plunger rod is used as part of the pneumatic actuation section. The rod is then used to open or close the valve by applying pressure on the membrane. The addition of the plunger mechanism to the symmetric normally closed valve structure does not remove drawbacks such as the dead volume and cross-contamination issues.

Another fluidic actuation system, where a microfluidic cartridge is covered by an elastic membrane and then contacted with a pneumatic interface is disclosed in US20120266986. The pneumatic interface and cartridge are reversibly held together by keeping the system under positive pressure. This system also suffers from problems of possible cross-contamination and dead volumes.

In view of the foregoing, it is an object of this invention to provide a microfluidic network device with valves to control flow of fluids in channels of the microfluidic network that is reliable, yet economical to produce and to use.

For certain applications, it is another object of the invention to provide a microfluidic network device for reagent delivery in microfluidic systems that is reliable and versatile.

In particular, it is advantageous to provide a microfluidic network device that reduces the risk of cross contamination and problems associated with dead volumes in microfluidic networks.

It is advantageous to provide a microfluidic network device that is versatile and can be used or adapted for different applications.

It is advantageous to provide a microfluidic network device that is compact.

For certain applications, it is advantageous to provide a microfluidic network device that enables efficient and economical mixing of liquids, for instance two or more reagent liquids, or sample containing liquids with reagent liquids.

Objects of the invention have been achieved by providing a microfluidic network device according to claim 1.

In a first aspect of the invention, a microfluidic network device including a base portion comprises a plurality of microfluidic inlet channels and at least one common outlet channel, and a plurality of valves interconnecting an outlet end of each of said plurality of inlet channels to said at least one common outlet channel. Each valve comprises a deflectable member displaceable between a valve closed position in which fluid communication between the inlet channel and common outlet channel is closed, and a valve open position in which fluid communication between the inlet channel and common outlet channel is open. At least one common outlet channel comprises valve sections and intermediate sections interconnecting the valve sections. Each valve section of the at least one outlet channel is configured to cooperate with a corresponding valve. The valve sections are positioned adjacent respective said outlet ends of the inlet channels.

According to a second aspect of the invention, a microfluidic network device is configured to supply reagents to a biological tissue sampling device, the microfluidic network device comprising a plurality of microfluidic inlet channels connected to respective sources of said reagents, at least one common outlet channel, and a plurality of valves interconnecting an outlet end of each of said plurality of inlet channels to said at least one common outlet channel. Each valve is switchable between a valve closed position in which fluid communication between the inlet channel and common outlet channel is closed, and a valve open position in which fluid communication between the inlet channel and common outlet channel is open.

According to a third aspect of the invention, a valve for a microfluidic network device, comprises a valve inlet orifice, a valve outlet orifice, a valve separating wall portion positioned between the inlet orifice and outlet orifice, and a deflectable member extending over the valve inlet orifice, valve separating wall portion, and valve outlet orifice such that when the deflectable member is pressed against the valve separating wall portion, fluid communication between the valve inlet orifice and valve outlet orifice of the valve is prevented. The valve outlet orifice has a smaller surface area projecting onto the deflectable member than a surface area projected by the valve inlet orifice on the deflectable member.

According to another aspect of the invention, a method of operating a microfluidic network device comprises a) priming each of the inlet channels by injecting respective reagents in each of the inlet channels, while expulsing liquid via either a purge line or the device outlet by controlling respective valves interconnecting the inlet channels to the common outlet channel (22), b) priming a sampling device connected downstream to said device outlet, by injecting at least one selected reagent through an inlet channel and out through the outlet, the selected reagent being preferably either a washing agent or a first reagent for treatment of a sample provided in the sampling device, c) delivering a reagent configured to react with the sample to the sampling device, d) optionally delivering a washing liquid, e) optionally repeating steps c) and d) for different reagents.

In an embodiment, the method may comprise pre-pressurization of the inlet and outlet of the microfluidic network device, where the inlet and outlet of the microfluidic network are both connected to a pressure source. The pressure on the inlet or on the outlet may be varied to control the desired flow rate.

In an embodiment, the method may comprise mixing of reagents in a mixing network of the microfluidic network device.

In an embodiment, the microfluidic network device may be connected to a sampling device disposed downstream of the network device and to which reagents are supplied. Reagents may for instance include antibodies, imaging buffers, and washing solutions.

In an embodiment, the plurality of inlet channels may be arranged in an essentially parallel juxtaposed manner.

In an advantageous embodiment, the valve outlet ends of adjacent inlet channels may be offset such that the plurality of valve outlet ends are not formed along a straight line, whereby for instance the common outlet channel extends along a generally zig-zag or oscillating path.

In an embodiment, the common outlet channel extends generally in a direction transverse to the inlet channels. Valve sections of the common outlet channel may therefore extend transversely to the outlet end of the inlet channel to form an essentially "T" shaped arrangement.

In an embodiment, the valve comprises a valve inlet orifice formed at the outlet end of the inlet channel, and a valve outlet orifice above, or forming a portion of, the common outlet channel, and separated from the valve inlet orifice by a valve separating wall portion.

In an embodiment, the deflectable member extends over the valve inlet orifice, valve separating wall portion, and valve outlet orifice such that when the deflectable member is pressed against the valve separating wall portion, fluid communication between the valve inlet orifice and valve outlet orifice of the valve is prevented.

In an embodiment, the valve outlet orifice forms part of the common outlet channel.

In an embodiment, the valve outlet orifice has a smaller surface area projecting onto the deflectable member than a surface area projected by the valve inlet orifice on the deflectable member, preferably the surface area of the valve inlet orifice projected on the deflectable member is more than two times the projected surface area of the valve outlet orifice, more preferably more than three times.

In an embodiment, the deflectable member comprises an elastic membrane that overlaps the inlet and outlet orifices, the valve separating wall portion, and optionally also edge surfaces bounding the valve inlet and outlet orifices.

In an embodiment, the valve body portion comprises actuation chambers that define the deformable portion of the deflectable member that overlaps the orifices and any surface areas around the edges of the orifices, the valve body portion providing a separation between adjacent valves.

In an embodiment, the microfluidic network device further comprises a valve actuation system comprising pneumatic or hydraulic actuation lines connected to actuation chambers positioned above the valve deflectable members.

In an embodiment, an outermost inlet channel is connected to a washing solution configured to ensure that during washing, between application of different reagents, the common outlet channel is fully washed from one end to another end to avoid contamination with liquids of a subsequent treatment cycle.

In an embodiment, the microfluidic network device includes a mixing network comprising two or more mixing channels interconnected by valves to the common outlet channel configured to direct liquid from reagent lines to circulate within the mixing network.

In an advantageous embodiment, at least one of the plurality of inlet channels comprise flow control portions comprising resistive channels, for instance by a serpentine channel configuration that slows the flow of fluid through the inlet channels.

Figure 2A:
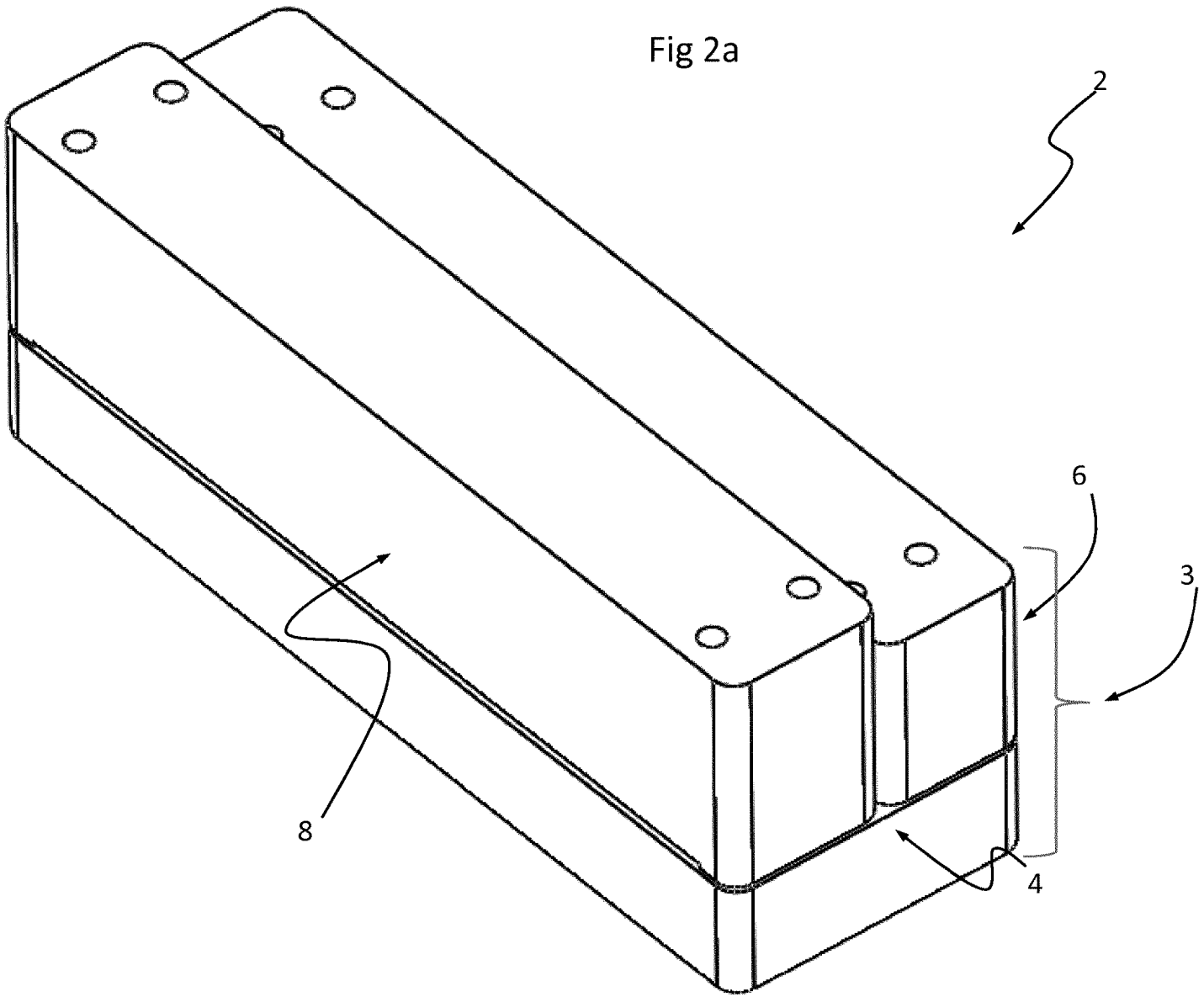
Figure 2B:
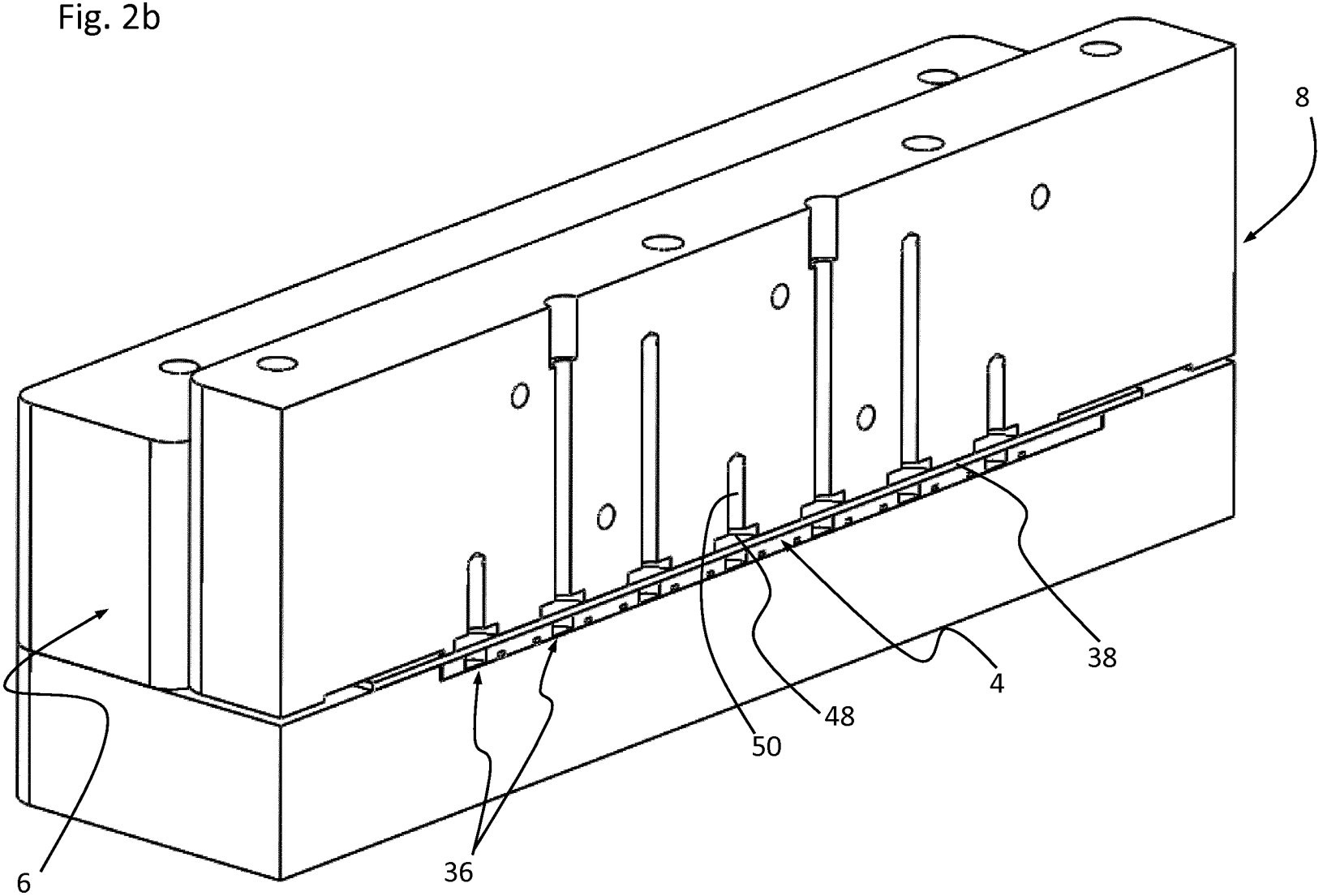
Figure 2C:
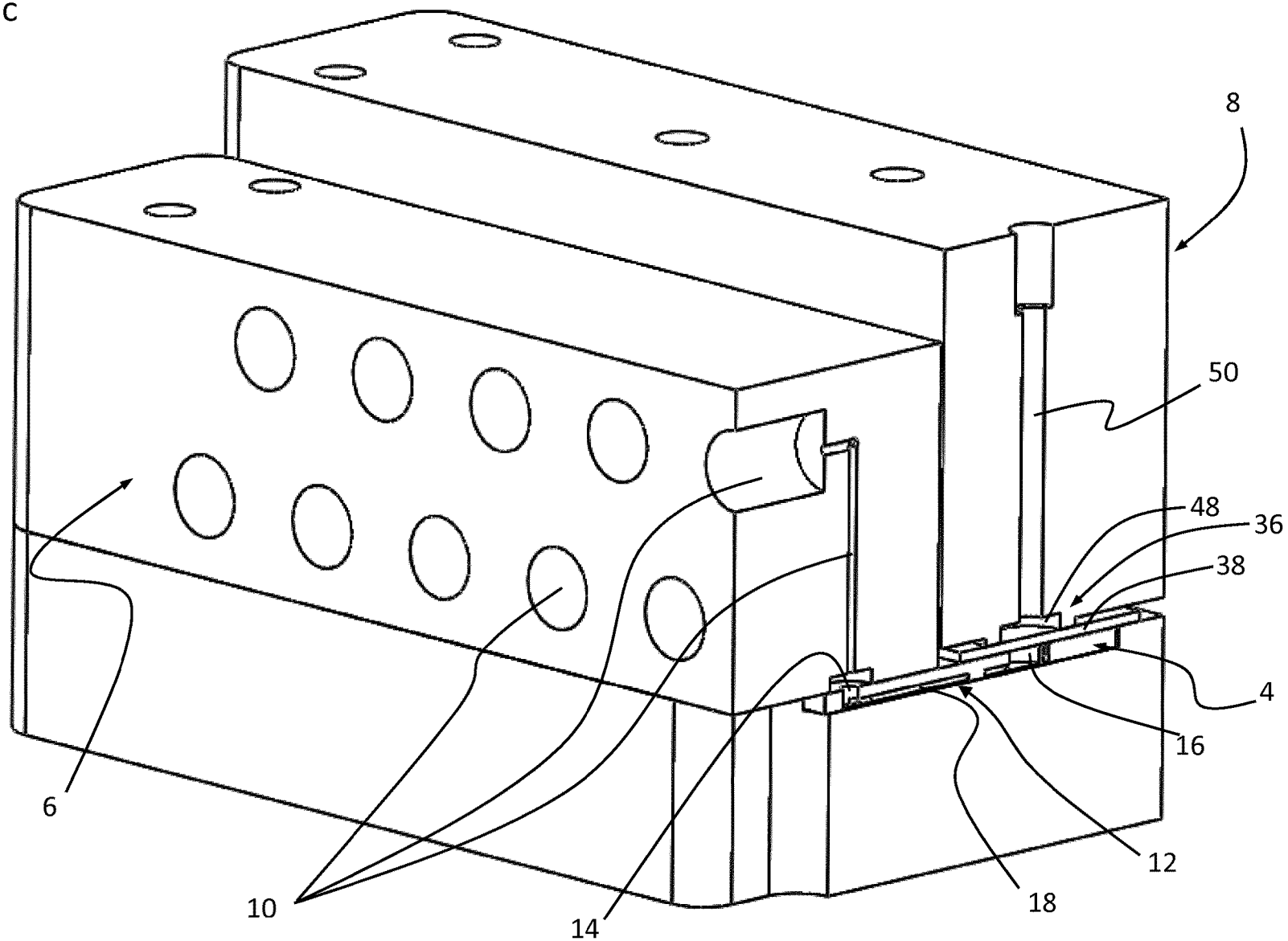
Figure 2D:
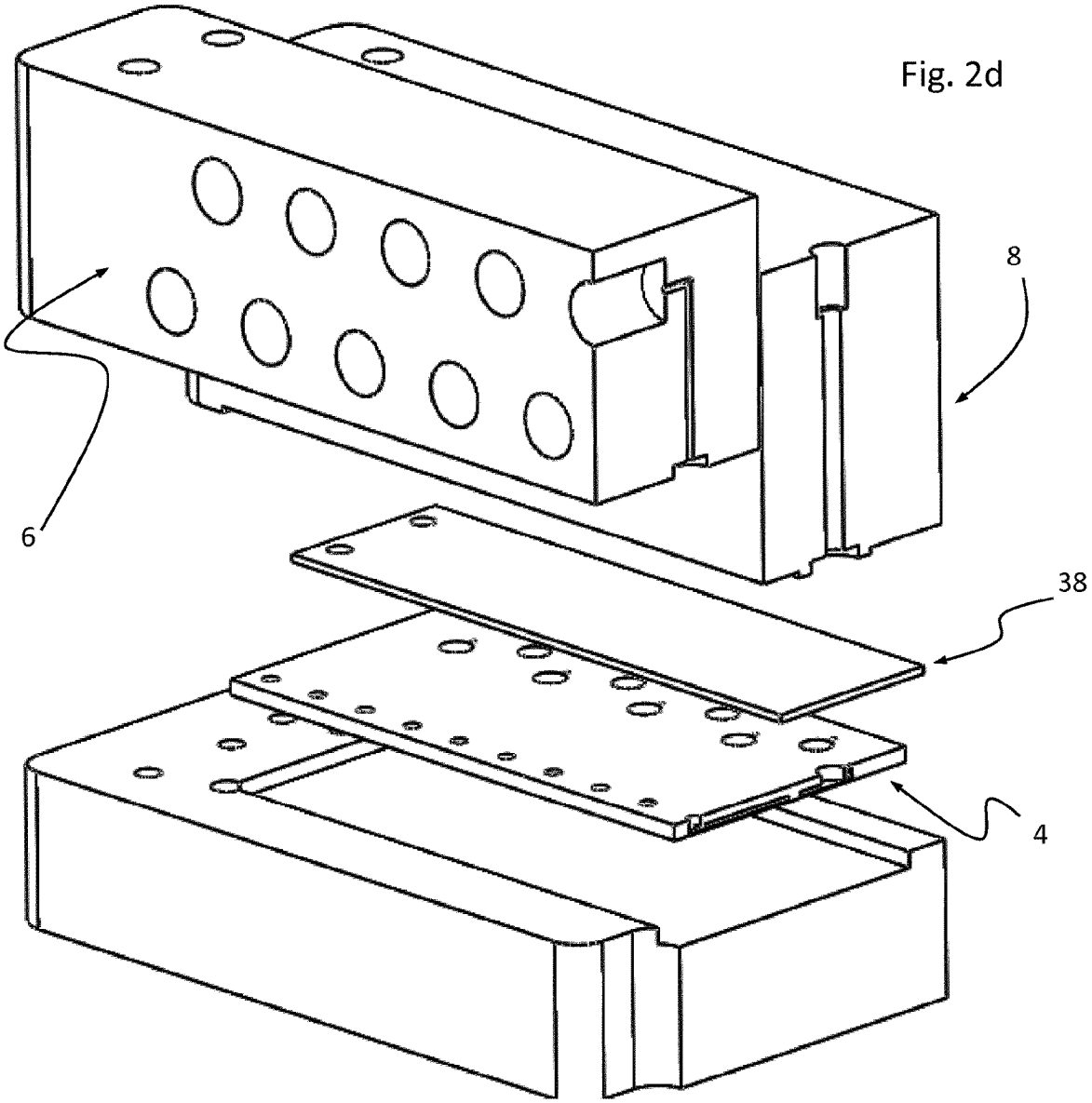

Further objects and advantageous features of the invention will be apparent from the claims, from the detailed description, and annexed drawings, in which:

FIG. 1 is a schematic simplified view of a microfluidic network device according to an embodiment of the invention;

FIG. 2*a* is a perspective schematic view of a microfluidic network device according to an embodiment of the invention;

FIGS. 2*b* and 2*c* are perspective schematic cross section views, and FIG. 2*d* is an exploded perspective schematic cross section view, of the microfluidic network device of FIG. 2*a;*

Figure 3:
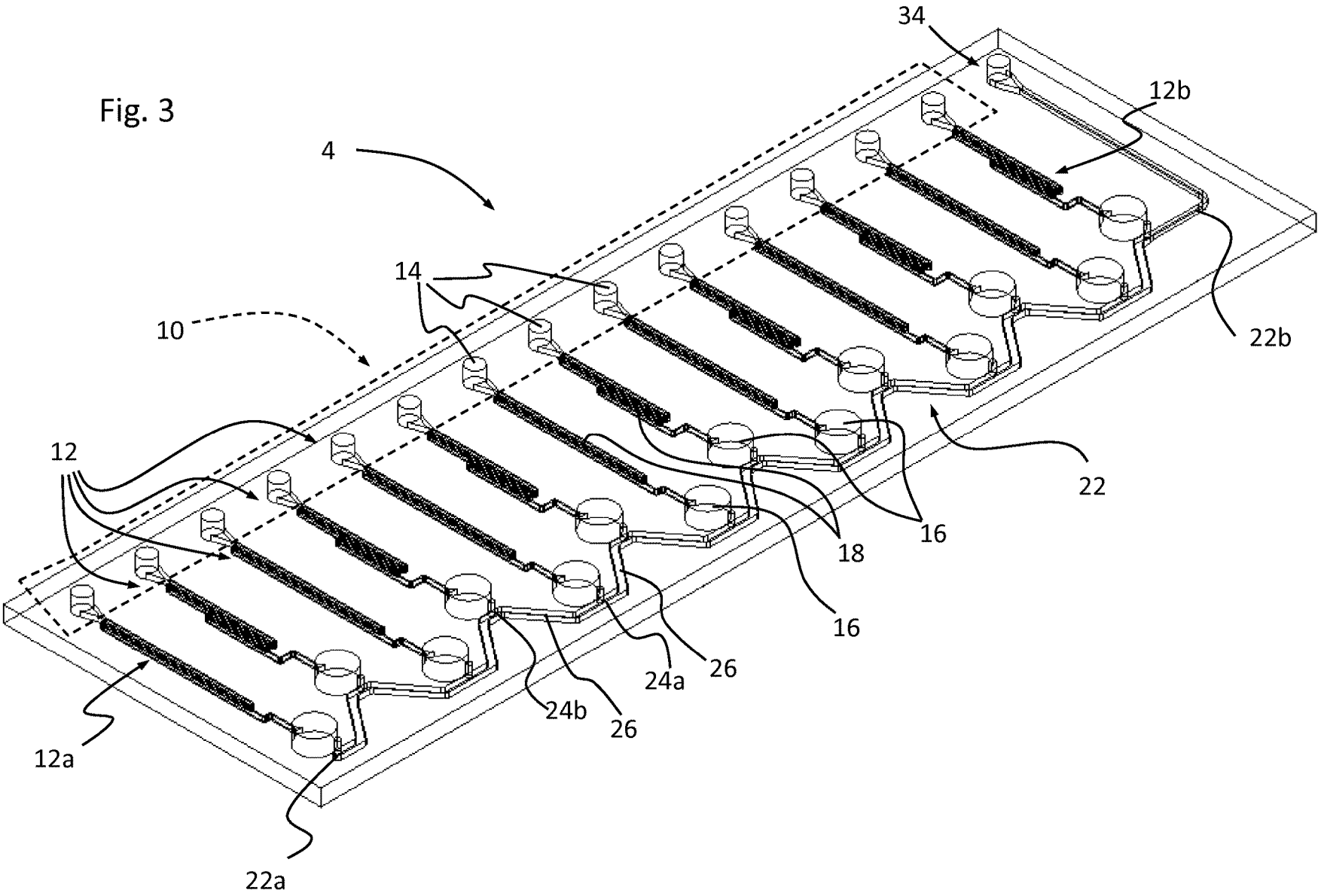
Figure 4A:
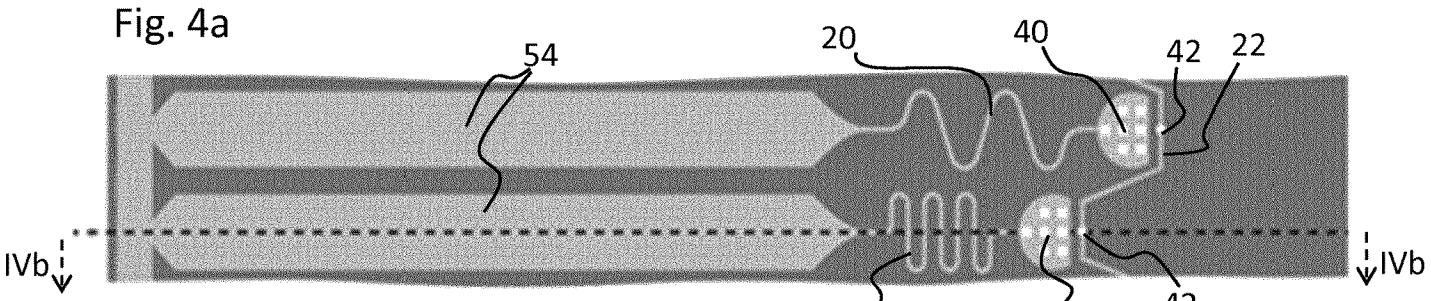
Figure 4B:
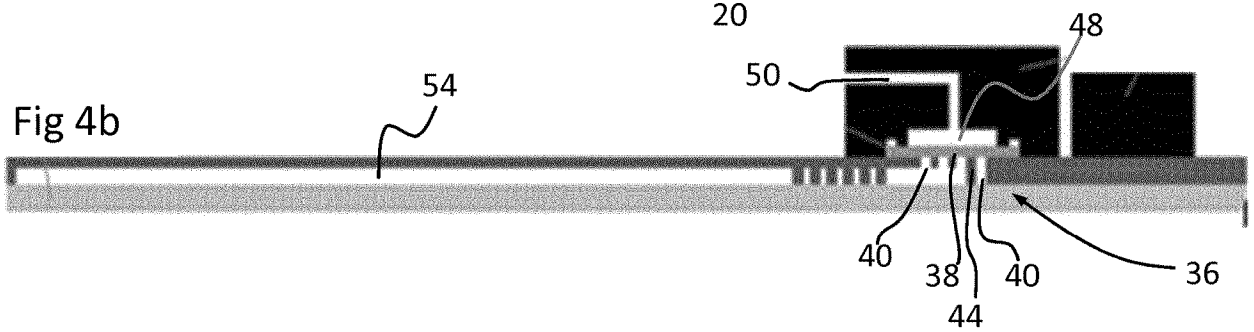

FIG. 3 is a perspective schematic view of a base portion of a microfluidic network device according to an embodiment of the invention;

FIG. 4*a* is a schematic plan view of a portion of a microfluidic network device according to an embodiment of the invention and FIG. 4*b* is a cross section view through line IVb-IVb of FIG. 4*a;*

Figure 5B:
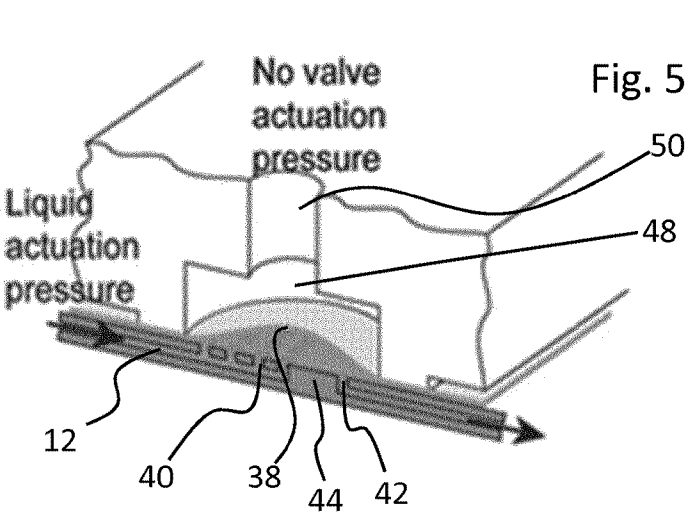
Figure 5A:
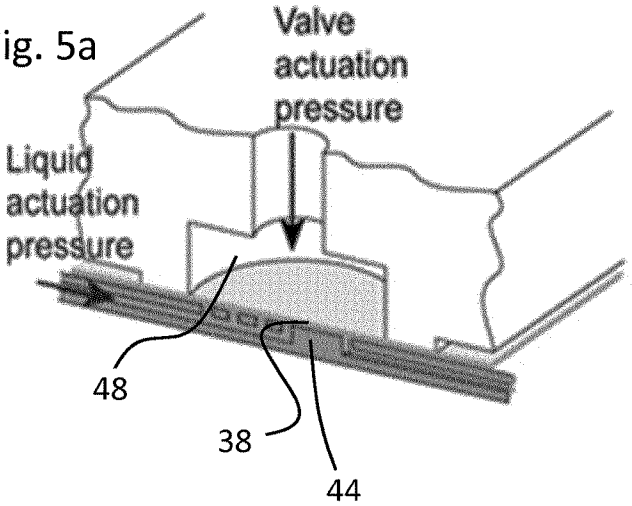
Figure 6A:
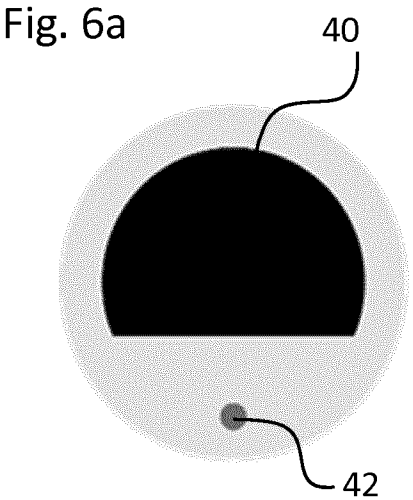
Figure 6B:
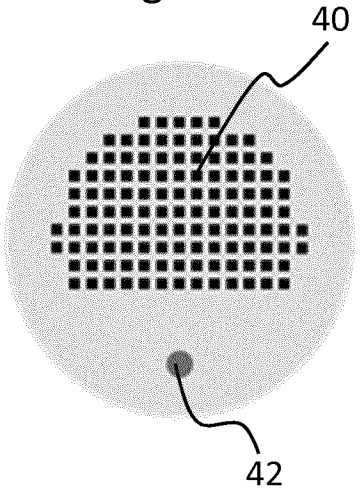
Figure 6C:
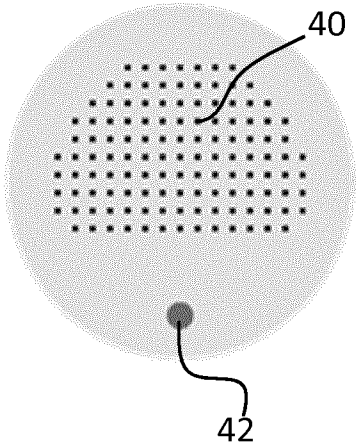

FIGS. 5*a* and 5*b* are schematic cross-sectional views of a valve of a microfluidic network device according to an embodiment of the invention, FIG. 5*a* showing the valve closed and FIG. 5*b* showing the valve open;

FIGS. 6*a*, 6*b* and 6*c* are schematic illustrations of valve inlet and outlet orifices according to different embodiments.

Referring to the figures, a microfluidic network device 2 comprises a body 3 comprising device inlets 10 fluidically connected via fluid channels in the body to one or more device outlets 34. The body 3 may be made of a monolithic structure or may be made from a plurality of parts that are assembled together. In the illustrated embodiment, the body 3 comprises a base portion 4, an inlet body portion 6 and a valve body portion 8. The microfluidic network device further comprises valves 36 positioned on at least some of the fluid channels for regulating the flow of fluids in the channels.

The microfluidic network device 2 may be connected to one or more fluid sources, including reagent sources and optionally one or more sample sources (depending on the application). In an embodiment, the microfluidic network device may be provided with onboard reservoirs 54 that store in the device a supply volume of reagent or sample sufficient for the applications for which the microfluidic network device is intended. Alternatively, or in addition, the inlet body portion 6 of the microfluidic network device may be connected to external fluid supplies. The reservoirs 54 can be prefilled by injecting liquids into the reservoirs from external sources, or can be provided in the form of prefilled cartridges that are loaded into the microfluidic network device such that they fluidically couple with respective fluid channels of the network device. In an embodiment, at least some of the on-board reservoirs use the same pressure source, for instance a pneumatic actuation system, as the one available to actuate the valves and pump the liquid reagents.

The use of the term "reagent" in the present application is intended to cover a variety of liquids or gases that are used in the microfluidic network device for various applications. Reagents may for instance comprise antibodies, imaging probes, washing buffers, chemical reagents, water, saline solutions and other liquids used in the application concerned. Sample liquids are intended to mean liquids that contain samples on which testing is applied, such samples for instance containing biological tissues or other microbiological matter, pollutants, or other substances on which a test on the properties thereof is intended to be carried out by a sampling device disposed downstream of the microfluidic network device.

The microfluidic network device may also be configured and used for mixing liquids in order to prepare reagents and/or sample containing solutions for a subsequent treatment.

The microfluidic network device may also be configured and used for mixing reagents in view of generating a chemical reaction to prepare a resultant liquid.

In an embodiment, the microfluidic network device 2 may be connected to a sampling device 1 to which reagents (antibodies, imaging buffers, washing solutions, etc. . . . ) are supplied.

In an embodiment connected to a sampling device 1 that is arranged downstream of the microfluidic network device, an optional mixing device may be configured to supply only reagents. The sample, for instance a tissue sample, is provided in the sampling device.

Sampling devices of various types are per se known (for instance as described in WO 2013/128322).

Although the sampling device may be a separate device connected by one or more fluid lines to the microfluidic network device, in an embodiment, the sampling device may be integrally provided in a fixed manner assembled to the microfluidic network device or monolithically formed with the microfluidic device.

The inlet body portion 6 of the microfluidic network device 2 comprises a plurality of inlet channels 12 connected to the device inlet or device inlets 10, each inlet channel 12 comprising an inlet end 14 and an outlet end 16 interconnected fluidically by an intermediate channel section 18. In the embodiments illustrated, there are a plurality of inlet channels 12 which for instance may advantageously be arranged in an essentially parallel juxtaposed manner in the base portion 4.

The microfluidic network device further comprises at least one outlet channel 22 that comprises valve sections 24*a* positioned adjacent to the outlet ends 16 of the inlet channels 12. The outlet ends 16 of adjacent inlet channels 12 may be offset such that the plurality of outlet ends 16 are not formed along a linear line but along a zigzag or wave shaped line, or other oscillating line shapes. In a preferable embodiment with a single outlet channel 22 adjacent the outlet ends 16 of the inlet channels 12, the common outlet channel thus being proximate to the outlet end 16 of the inlet channel also extends along a generally zigzag, wavy or oscillating path. The offset adjacent outlet ends 16 that form an oscillating arrangement when looking at the plurality of outlet ends 16 allows a more compact arrangement, namely a closer distance dl between adjacent inlet channels by providing more space at the outlet end 16 for positioning of a corresponding valve 36. In effect, the outlet ends 16 are connected to valve portions 24*a*, 24*b* of the common outlet channel 22 via a valve 36. The common outlet channel 22 thus extends generally in a direction transverse to the inlet channels 12, or at least the outlet end portion of the inlet channels. In the illustrated embodiments, valve portions 24*a* of the common outlet channel extend transversely to the outlet end portion of the inlet channel in an essentially "T" shaped arrangement.

The valve 36 may comprise a valve inlet orifice 40 formed at the outlet end 16 of the inlet channel, and a valve outlet orifice 42 above, or forming a portion of the common outlet channel 22, and separated from the valve inlet orifice 40 by a valve separating wall portion 44. The deflectable member 38 extends over the valve inlet orifice 40, valve separating wall portion, and valve outlet orifice 42 such that when the deflectable member 38 is pressed against the valve separating wall portion 44, fluid communication between the valve inlet orifice 40 and valve outlet orifice 42 of the valve is prevented (i.e. the valve is in a closed position). It may be noted that the valve outlet orifice 42 of the valve may either be a small orifice extending to the common outlet channel 22, but preferably forms part of the common outlet channel 22. In the latter variant, when liquid flows through the common outlet channel 22, the valve outlet orifice 42 of the valve 36 does not present any dead volume, and liquid in the valve outlet orifice is carried away by liquid flowing in the common outlet channel 22.

In a preferred embodiment, the valve outlet orifice 42 covered by the deflectable member 38 has a smaller surface area projecting onto the deflectable member 38 than the surface area projected by the valve inlet orifice 40 on the deflectable member 38. Preferably, the surface area of the valve inlet orifice 40 projected on the deflectable member 38 is more than two times the projected surface area of the valve outlet orifice 42, preferably more than three times, and more preferably more than five times. This configuration ensures that even if the pressure in the common outlet channel 22 is greater than the pressure in the inlet channel 12, up to a factor corresponding to the ratio of the surface areas of the valve inlet and outlet orifices, a reverse flow from the common outlet channel 22 into the inlet channel 12 is prevented. This in particular forms a safety mechanism against cross contamination between reagents and also prevents backflow of liquid.

In an embodiment, the valve 36 may be formed by a deflectable member 38 with elastic properties that overlaps the inlet and outlet orifices, the valve separating wall portion 44, and optionally also edge surfaces bounding the valve inlet and outlet orifices 40, 42. The valve body portion 8 may be configured to have actuation chambers 48 that define the deformable portion of the deflectable member 38 that overlaps the orifices 40, 42 and any surface areas around the edges of the orifices. The valve body portion 8 pressing against the membrane 38 or the base portion 4 thus also provides a separation between adjacent valves 36.

In an embodiment, the deflectable member 38 may comprise an elastic membrane, for instance in the form or a sheet of elastically deformable material.

In a variant, the deflectable member 38 may comprise a spring mounted valve plate, plunger or ball (not shown), for example comprising a compression spring that pushes the plate, plunger or ball against the edges of the outlet and inlet orifices 40, 42.

It may be noted that the notion of valve inlet orifice 40 and valve outlet orifice 42 may comprise a single continuous orifice as illustrated in FIG. 6*a* or a plurality of orifices for instance as shown in FIG. 6*b*. In particular, the valve inlet orifice, in view of its larger surface area, may be provided with a plurality of smaller orifices in order to provide better support for the deflectable member against the orifices, or to control the ratio of projected surface areas between the inlet and outlet.

The valve 36 may be provided with an actuation system that actively controls opening and closing of respective valves 36.

In a variant however, the valves may be passive and act as check-valves that are actuated by increasing the fluid pressure in the inlet channels 12.

In the active variant, the actuation system may control the valves by various means, for instance by electromagnetic, piezoelectric, pneumatic or hydraulic means that act on the deflectable member, for instance to press on the deflectable member to close the valve, or to release pressure on the deflectable member, or to lift up the deflectable member, to open the valve.

In an advantageous embodiment, the actuation system may comprise a pneumatic actuation system whereby a pneumatic actuation line 50 connects to an actuation chamber 48 positioned above the deflectable member 38 overlapping the outlet and inlet orifices 40, 42 and edges thereof.

In an embodiment, the pneumatic interface may be operated to close the valve by having a gas pressure inside the actuation chamber 48 that is greater than atmospheric pressure. In a variant, it is also possible that the deflectable member 38 has a positive elastic pressure against the outlet, inlet and valve separating wall portions and the valve opening is actuated by an under-pressure in the actuation chamber 48.

In an advantageous embodiment, there is a single outlet channel 22 that extends to a position adjacent to each outlet end 16 of a plurality of the inlet channels 12, a valve 36 comprising a deflectable member and actuation chamber being positioned over the valve inlet and outlet orifices such that when fluid flows through the common outlet channel it flows past each of the outlet portions of the valve thus eliminating any dead zones.

In an embodiment, an outermost inlet channel 12*a* may be connected to a washing solution that ensures that during washing, between application of different reagents, the common outlet channel 22 is fully washed from one end 22*a* to the other end 22*b* to avoid contamination with liquids of a subsequent treatment cycle. In such an embodiment, an inlet channel 12*a* at one end of the microfluidic network device connects to an end 22*a* of the common outlet channel 22 and the other end 22*b* of the common outlet channel is connected to an outlet 34 of the microfluidic network device that may either be a waste line, purge line, or a line connected to the sampling device.

The microfluidic network device 22 may therefore optionally comprise an outlet connected to the sampling device 1 as well as one or more purge or waste lines 37 for expulsing liquid without going through the sampling device 1 or other device downstream of the device outlet, or for initial priming of the device during elimination of bubbles within the microfluidic network channels.

In a variant of the invention, the microfluidic network device may be provided with a mixing network 30 comprising two or more mixing channels 32 interconnected by valves 36 that may be used to force liquid to circulate within the mixing network which may be provided with different configurations to mix at least two or more liquids. The liquids may be supplied to the mixing networks from reagent lines 33 of the microfluidic network or by one or more sample lines and may be used to mix either two or more reagents or reagents with one or more sampling liquids.

In advantageous embodiments, the intermediate channel sections 18 joining the inlet end 14 to the outlet end 16 of the inlet channels 12, may be provided with flow control portions 20. Flow control portions 20 may for instance comprise resistive channels that may be formed for instance by a serpentine channel configuration that slow the flow of fluid through the inlet channels. This allows to have a better control of fluid flow, especially in order to dampen pressure fluctuations present at the inlet end 40 of the inlet channels with respect to the outer end 42 where a valve 36 is positioned, or to control liquid flow through the valves. This also ensures that the flow velocity of different reagents flowing through a microfluidic chamber of the sampling device 5 is substantially the same irrespective on the length of the fluidic path from the inlet end of any inlet channel to the microfluidic chamber.

In an embodiment, the flow control portions 20 may be identical for a plurality of inlet channels 12. Alternatively, or in addition, flow control portions 20 may be configured with different flow resistance properties for different inlet channels. The varying flow resistance portions may be provided in order to take into account the properties (for instance viscosity) of the liquids flowing in the respective inlet channels, or to take into account the liquid volume supply requirements of particular reagents for the intended application.

The mixing network 30 may also comprise various per se known mixing systems for instance serpentine channels, resistive heater-type mixers, arrays of pillars, or tree networks which use flow splitting and recombining, and so on, to achieve effective and efficient mixing of liquids.

The mixing network 30 may comprise an inline valve 36*b* positioned along the common outlet channel 22, between the mixing inlet and outlet channels 32*a*, 32*b* of the mixing network such that reagents can be injected into the inlet channel 32*a* of the mixing network, flow through the mixing network 30 up through the adjacent mixing outlet channel 32*b* of the mixing network without flowing through the common outlet channel 22. In other words the inline valve 36*b* along the common outlet channel section 22*c* between mixing network fluid channels 32*a*, 32*b* can be used to force flow of reagents through the mixing network 30. The mixing network can be switched on and off by controlling the valves 36*a*, 36*b*, 36*c* between the inlet and outlet lines 32*a*, 32*b* of the mixing network and the common outlet channel 22 of the mixing device.

By way of example referring to FIG. 1, to mix a plurality of reagents, the corresponding reagent valves are opened, sequentially or simultaneously, while the mixer valves 36*a*, 36*c* are open and the in-line valve 36*b* closed. Reagent liquids thus flow into and through the mixer network 30. To bypass the mixer network, the mixer valves 36*a*, 36*c* may be closed and the inline valve 36*b* opened. Circulation of liquid through the mixer network may be unidirectional, or may be reversible to operate a forward and reverse flow of liquid in the mixer network for better mixing.

In an embodiment, both the inlets 12 and one or more outlets 34 of the microfluidic network device may be under a positive pressure, namely a pressure above atmospheric pressure, in order to reduce bubble formation within the microfluidic network device, by having a higher than atmospheric pressure inside the microfluidic environment. Flow between inlet 12 and outlet 34 may thus be controlled by a differential pressure, by increasing the pressure on the inlet side, and/or lowering the pressure on the outlet side.

| List of references used |
|---|
| microfluidic network device 2 |
| device inlets 10 |
| device outlet 34 |
| body 3 |
| base portion 4 |
| inlet body portion 6 |
| valve body portion 8 |
| fluid channels |
| inlet channel 12 |
| first inlet channel 12a |
| inlet end 14 |
| outlet end 16 |
| intermediate channel section18 |
| flow control portion 20 (resistive, e.g. serpentine portion) |
| common outlet channel 22 |
| valve sections 24, 24a, 24b |
| intermediate sections 26 |
| first end 22a |
| purge channel 28 |
| mixer network 30 |
| mixing channels 32 |
| mixer valves 36a, 36b, 36c |
| valves 36 (reagent, mixer, purge, exit, ...) |
| deflectable member 38 |
| valve inlet orifice 40 |
| valve outlet orifice 42 |
| valve separating wall portion 44 |
| actuation system |

-continued

| List of references used |
|---|
| actuation chamber 48 |
| actuation line 50 |
| reagent and sample sources |
| onboard reservoir 54 |
| reagent line 33 |
| outlet line 35 |
| purge line 37 |
| sampling device 1 |

The invention claimed is:

1. A microfluidic network device comprising: a base portion comprising a plurality of microfluidic inlet channels and at least one common outlet channel, and a plurality of valves interconnecting an outlet end of each of said plurality of inlet channels to said at least one common outlet channel, wherein each valve of the plurality of valves is associated with one of the plurality of inlet channels and comprises a deflectable member displaceable between a valve closed position in which fluid communication between the associated one of the plurality of inlet channels and the at least one common outlet channel is closed, and a valve open position in which fluid communication between the associated one of the plurality of inlet channels and the at least one common outlet channel is open, said at least one common outlet channel comprises ail channel section consisting of a first plurality of sub-sections and a second plurality of sub-sections interconnecting the sub-sections of the first plurality of sub-sections, forming an alternating sequence of sub-sections of the first and second pluralities of sub-sections, wherein each sub-section of the first plurality of sub-sections is configured to cooperate with a single corresponding valve of the plurality of valves, and each sub-section of the first plurality of sub-sections is positioned adjacent respective said outlet end of the associated one of the plurality of inlet channels, wherein the channel section of the at least one common outlet channel extends in a direction transverse to the inlet channels, and wherein the sub-sections of the first plurality of sub-sections extend transversely to the outlet end of each of said plurality of inlet channels, thus forming a "T" shaped arrangement, wherein each valve of the plurality of valves comprises a valve inlet orifice formed at the outlet end of the associated one of the plurality of inlet channels, and a valve outlet orifice forming a portion of the channel section of the at least one common outlet channel, and separated from the valve inlet orifice by a valve separating wall portion, wherein the deflectable member comprises an elastic membrane that overlaps the inlet and outlet orifices, the valve separating wall portion, and optionally also edge surfaces bounding the valve inlet and outlet orifices.

2. The microfluidic network device according to claim 1, wherein the microfluidic network device is configured to be connected to a sampling device arranged downstream of the microfluidic network device and to which reagents, which may include antibodies, imaging buffers, and washing solutions, are supplied.

3. The microfluidic network device according to claim 1, wherein the outlet ends of adjacent inlet channels are offset such that the plurality of outlet ends are not formed along a straight line, whereby the at least one common outlet channel extends along an oscillating path.

4. The microfluidic network device according to claim 1, wherein the deflectable member extends over the valve inlet orifice, valve separating wall portion, and valve outlet orifice such that when the deflectable member is pressed against the valve separating wall portion, fluid communication between the valve inlet orifice and valve outlet orifice of each valve of the plurality of valves is prevented.

5. The microfluidic network device according to claim 1, further comprising a valve body portion comprising actuation chambers that define a deformable portion of the deflectable member that overlaps the valve inlet and outlet orifices and any surface areas around edges of the valve inlet and outlet orifices, the valve body portion providing a separation between adjacent valves of the plurality of valves.

6. The microfluidic network device according to claim 1, further comprising a valve actuation system comprising pneumatic or hydraulic actuation lines connected to actuation chambers positioned above the deflectable members of the plurality of valves.

7. The microfluidic network device according to claim 1, wherein an outermost inlet channel of the plurality of inlet channels is configured to be connected to a supply of a washing solution configured to ensure that during washing, between application of different reagents, the at least one common outlet channel is fully washed from one end to another end to avoid contamination with liquids of a subsequent treatment cycle.

8. The microfluidic network device according to claim 1, wherein the microfluidic network device includes a mixing network comprising two or more mixing channels interconnected by mixing valves to the at least one common outlet channel configured to direct liquid from reagent lines to circulate within the mixing network.

9. The microfluidic network device according to claim 1, wherein at least one of the plurality of inlet channels comprises flow control portions comprising resistive channels.

10. A method of operating a microfluidic network device including a base portion comprising a plurality of microfluidic inlet channels and at least one common outlet channel, and a plurality of valves interconnecting an outlet end of each of said plurality of inlet channels to said at least one common outlet channel, wherein each valve of the plurality of valves is associated with one of the plurality of inlet channels and comprises a deflectable member displaceable between a valve closed position in which fluid communication between the associated one of the plurality of inlet channels and the at least one common outlet channel is closed, and a valve open position in which fluid communication between the associated one of the plurality of inlet channels and the at least one common outlet channel is open, said at least one common outlet channel comprises channel section consisting of a first plurality of sub-sections and a second plurality of sub-sections interconnecting the sub-sections of the first plurality of sub-sections, forming an alternating sequence of sub-sections of the first and second pluralities of sub-sections, wherein each sub-section of the first plurality of sub-sections is configured to cooperate with a single corresponding valve of the plurality of valves and each sub-section of the first plurality of sub-sections is positioned adjacent respective said outlet end of the associated one of the plurality of inlet channels, wherein the channel section of the at least one common outlet channel extends in a direction transverse to the inlet channels, and wherein the sub-sections of the first plurality of sub-sections extend transversely to the outlet end of each of said plurality of inlet channels, thus forming a "T" shaped arrangement, wherein each valve of the plurality of valves comprises a valve inlet orifice formed at the outlet end of the associated one of the plurality of inlet channels, and a valve outlet orifice forming a portion of the channel section of the at least one common outlet channel, and separated from the valve inlet orifice by a valve separating wall portion, wherein the deflectable member comprises an elastic membrane that overlaps the inlet and outlet orifices, the valve separating wall portion, and optionally also edge surfaces bounding the valve inlet and outlet orifices the microfluidic network device further comprising device inlets fluidically connected to inlet ends of the plurality of inlet channels and a device outlet fluidically connected to the at least one common outlet channel, the method comprising:

a) priming each of the plurality of inlet channels by injecting respective reagents in each of the plurality of inlet channels, while expulsing liquid via either a purge line or the device outlet by controlling the valves of the plurality of valves interconnecting the plurality of inlet channels to the at least one common outlet channel, b) priming a sampling device connected downstream to said device outlet, by injecting a first reagent through at least one inlet channel of the plurality of inlet channels and out through the device outlet, c) delivering a second reagent configured to react with the sample to the sampling device, d) optionally delivering a washing liquid, and e) optionally repeating steps c and d for different reagents.

11. The method according to claim 10 comprising pre-pressurization of the device inlets and the device outlet of the microfluidic network device, where the device inlets and the device outlet of the microfluidic network are both connected to a pressure source.

12. The method according to claim 11 wherein a pressure on the device inlets is applied for obtaining a predefined flow rate in one of the plurality of inlet channels or in the at least one common outlet channel.

13. The method according to claim 10 further comprising mixing of a third reagent with a fourth reagent in a mixing network of the microfluidic network device.

* * * * *